US006409853B1

(12) United States Patent
Thamboo et al.

(10) Patent No.: US 6,409,853 B1
(45) Date of Patent: Jun. 25, 2002

(54) LARGE FORGING MANUFACTURING PROCESS

(75) Inventors: Samuel V. Thamboo, Latham; Ling Yang, Niskayuna, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/426,306

(22) Filed: Oct. 25, 1999

(51) Int. Cl.[7] ..... C22F 1/10

(52) U.S. Cl. ..... 148/677; 148/410; 148/428; 148/676

(58) Field of Search ..... 148/677, 410, 148/428, 676

(56) References Cited

U.S. PATENT DOCUMENTS

| | | | | | |
|---|---|---|---|---|---|
| 4,793,868 | A | * | 12/1988 | Chang | 148/11.5 N |
| 4,957,567 | A | * | 9/1990 | Kruegar et al. | 148/12.7 N |
| 5,120,373 | A | * | 6/1992 | Miller et al. | 148/564 |
| 5,360,496 | A | * | 11/1994 | Kuhlman et al. | 148/677 |
| 5,374,323 | A | * | 12/1994 | Kuhlman et al. | 148/677 |
| 6,193,823 | B1 | * | 2/2001 | Morra | 148/677 |

OTHER PUBLICATIONS

"Study of Secondary Grain Growth on 718 Alloy, " JF Uginet et al., The Minerals, Metals & Materials Society, 1997, pp. 343–351.
"39$^{th}$ GE Turbine State–of–the–Art Technology Seminar", Tab 1, ""F" Technology—the First Half–Million Operating Hours", H.E. Miller, Aug. 1996.
"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.
"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy –Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations fo GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, " J.R. Johnston, Aug. 1996.
"39th GE Turbine State–of–the–Art Technology Seminar", Tab 16, "Gas Turbine Repair Technology", Crimi et al., Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.

(List continued on next page.)

*Primary Examiner*—Roy King
*Assistant Examiner*—Harry Wilkins, III
(74) *Attorney, Agent, or Firm*—Nixon & Vanderhye P.C.

(57) ABSTRACT

A process for forging large components of Alloy 718 material so that the components do not exhibit abnormal grain growth includes the steps of:

a) providing a billet with an average grain size between ASTM 0 and ASTM 3;
b) heating the billet to a temperature of between 1750° F. and 1800° F.;
c) upsetting the billet to obtain a component part with a minimum strain of 0.125 in at least selected areas of the part;
d) reheating the component part to a temperature between 1750° F. and 1800° F.;
e) upsetting the component part to a final configuration such that said selected areas receive no strains between 0.01 and 0.125;
f) solution treating the component part at a temperature of between 1725° F. and 1750° F.; and
g) aging the component part over predetermined times at different temperatures.

A modified process achieves abnormal grain growth in selected areas of a component where desirable.

6 Claims, 2 Drawing Sheets

OTHER PUBLICATIONS

"39th GE Turbine State–of–the–Art Technology Seminar", Tab 20, "Steam Turbines for Large Power Applications", Reinker et al., Aug. 1996.

"39th GE Turbine State–of–the–Art Technology Seminar", Tab 21, "Steam Turbines for Ultrasupercritical Power Plants", Retzlaff et al., Aug. 1996.

"39th GE Turbine State–of–the–Art Technology Seminar", Tab 22, "Steam Turbine Sustained Efficiency", P. Schofield, Aug. 1996.

"39th GE Turbine State–of–the–Art Technology Seminar", Tab 23, "Recent Advances in Steam Turbines for Industrial and Cogeneration Applications", Leger et al., Aug. 1996.

"39th GE Turbine State–of–the–Art Technology Seminar", Tab 24, "Mechanical Drive Steam Turbines", D. R. Leger, Aug. 1996.

"39th GE Turbine State–of–the–Art Technology Seminar", Tab 25, "Steam Turbines for STAG™ Combined–Cycle Power Systems", M. Boss, Aug. 1996.

"39th GE Turbine State–of–the–Art Technology Seminar", Tab 26, "Congeneration Application Considerations", Fisk et al., Aug. 1996.

"39th GE Turbine State–of–the–Art Technology Seminar", Tab 27, "Performance and Economic Considerations of Repowering Steam Power Plants", Stoll et al., Aug. 1996.

"39th GE Turbine State–of–the–Art Technology Seminar", Tab 28, "High–Power–Density™ Steam Turbine Design Evolution", J. H. Moore, Aug. 1996.

"39th GE Turbine State–of–the–Art Technology Seminar", Tab 29, "Advances in Steam Path Technologies", Cofer, IV, et al., Aug. 1996.

"39th GE Turbine State–of–the–Art Technology Seminar", Tab 30, "Upgradable Opportunities for Steam Turbines", D. R. Dreier, Jr., Aug. 1996.

"39th GE Turbine State–of–the–Art Technology Seminar", Tab 31, "Uprate Options for Industrial Turbines", R. C. Beck, Aug. 1996.

"39th GE Turbine State–of–the–Art Technology Seminar", Tab 32, "Thermal Performance Evaluation and Assessment of Steam Turbine Units", P. Albert, Aug. 1996.

"39th GE Turbine State–of–the–Art Technology Seminar", Tab 33, "Advances in Welding Repair Technology" J. F. Nolan, Aug. 1996.

"39th GE Turbine State–of–the–Art Technology Seminar", Tab 34, "Operation and Maintenance Strategies to Enhance Plant Profitability", MacGillivray et al., Aug. 1996.

"39th GE Turbine State–of–the–Art Technology Seminar", Tab 35, "Generator Insitu Inspections", D. Stanton.

"39th GE Turbine State–of–the–Art Technology Seminar", Tab 36, "Generator Upgrade and Rewind", Halpern et al., Aug. 1996.

"39th GE Turbine State–of–the–Art Technology Seminar", Tab 37, "GE Combined Cycle Product Line and Performance", Chase et al., Aug. 1996.

"39th GE Turbine State–of–the–Art Technology Seminar", Tab 38, "GE Combined Cycle Experience", Maslak et al., Aug. 1996.

"39th GE Turbine State–of–the–Art Technology Seminar" Tab 39, "Single–Shaft Combined Cycle Power Generation Systems", Tomlinson et al., Aug. 1996.

"Advanced Turbine System Program—Conceptual Design and Product Development", Annual Report, Sep. 1, 1994–Aug. 31, 1995.

"Advanced Turbine Systems (ATS Program) Conceptual Design and Product Development", Final Technical Progress Report, vol. 2—Industrial Machine, Mar. 31, 1997, Morgantown, WV.

"Advanced Turbine Systems (ATS Program), Conceptual Design and Product Development", Final Technical Progress Report, Aug. 31, 1996, Morgantown, WV.

"Advanced Turbine Systems (ATS) Program, Phase 2, Conceptual Design and Product Development", Yearly Technical Progress Report, Reporting Period: Aug. 25, 1993–Aug. 31, 1994.

"Advanced Turbine Systems" Annual Program Review, Preprints, Nov. 2–4, 1998, Washington, D.C. U.S. Department of Energy, Office of Industrial Technologies Federal Energy Technology Center.

"ATS Conference" Oct. 28, 1999, Slide Presentation.

"Baglan Bay Launch Site", various articles relating to Baglan Energy Park.

"Baglan Energy Park", Brochure.

"Commericalization", Del Williamson, Present, Global Sales, May 8, 1998.

"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.

"Exhibit panels used at 1995 product introduction at PowerGen Europe".

"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Job Ebacher, VP, Power Gen Technology, May 8, 1998.

"H Testing Process", Job Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21st Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct. 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiements: Geometry, Mixing, and Flame Structure Issues", Gupta et al., pp. 516–538, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct. 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry—University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535–552, Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.

"Proceedings of the Advanced Turbine Systems Annual Program Review Meeting", "Ceramic Stationary Gas Turbine", Mark van Roode, pp. 633–658, Nov., 1996.

"Proceedings of the Advanced Turbine Systems Annual Program Review Meeting", "Western European Status of Ceramics for Gas Turbines", Tibor Bornemisza, pp. 659–670, Nov., 1996.

"Proceedings of the Advanced Turbine Systems Annual Program Review Meeting", "Status of Ceramic Gas Turbines in Russia", Mark van Roode, p. 671, Nov., 1996.

"Status Report: The U.S. Department of Energy's Advanced Turbine systems Program", facsimile dated Nov. 7 , 1996.

"Testing Program Results Validate GE's H Gas Turbine–High Efficiency, Low Cost of Electricity and Low Emissions", Roger Schonewald and Patrick Marolda, (no date available).

"Testing Program Results Validate GE's H Gas Turbine—High Efficiency, Low Cost of Electricity and Low Emissions", Slide Presentation—working draft, (no date available).

"The Next Step In H . . . For Low Cost Per kW–Hour Power Generation", LP–1 PGE '98.

"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176—5628.

"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176–5340.
"Utility Advanced Turbine System (ATS) Technology Readiness Testing and Pre–Commericial Demonstration—Phase 3", Document #486132, Apr. 1–Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

Fig. 3
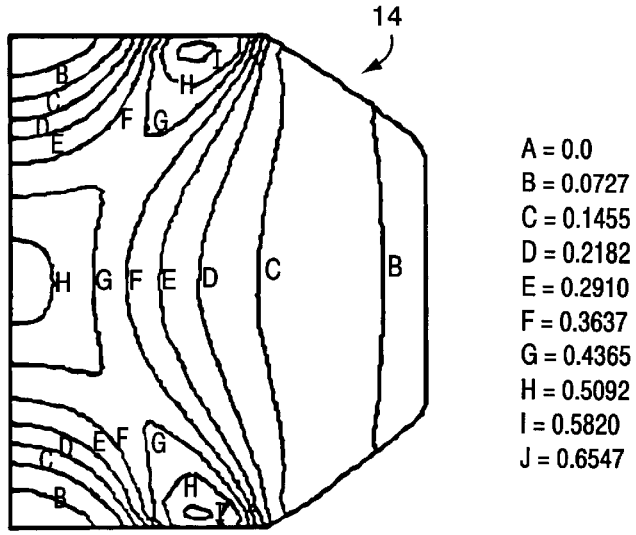
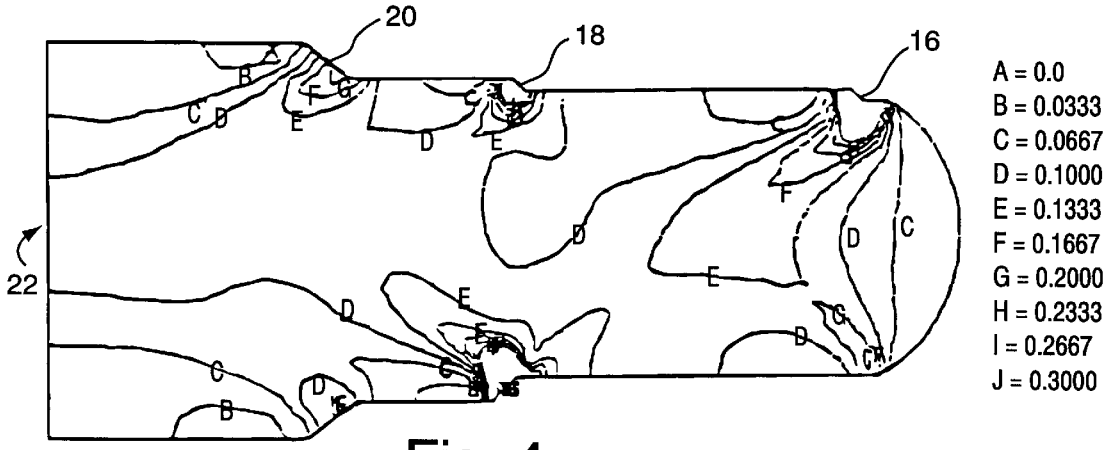
Fig. 4
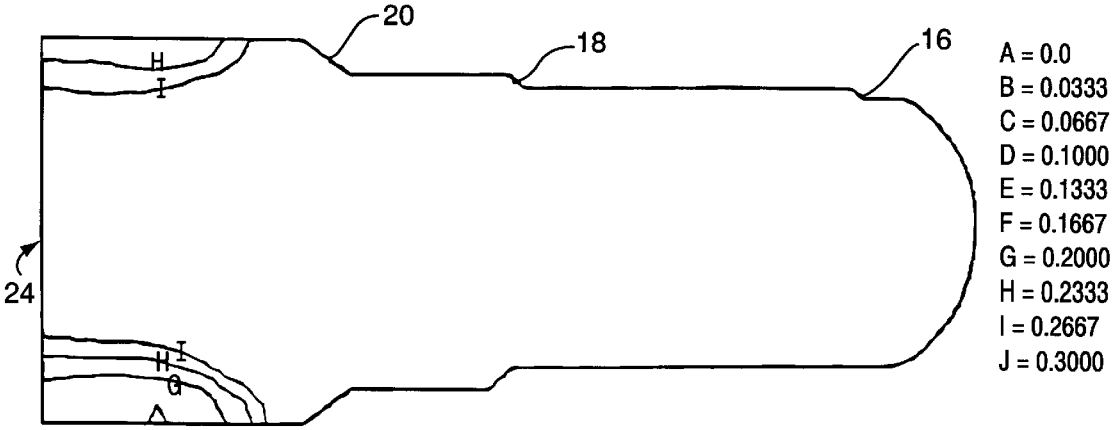
Fig. 5

LARGE FORGING MANUFACTURING PROCESS

This invention was made with Government support under Contract No. DE-FC21-95MC31176 awarded by the Department of Energy. The Government has certain rights in this invention.

BACKGROUND OF THE INVENTION

This invention relates to forgings used for large land-based gas turbines, and particularly to large Alloy 718 forgings that are prone to a problem known as abnormal grain growth.

The forging of Alloy 718 involves heating a billet and forging it in one or many steps (also referred to as upsets) to the final required shape. The billet must be reheated before each upset. After forging, the shaped parts are solution treated at a high temperature (1700–1825F), and then aged at a lower temperature (1325–1150F) to develop strength. Under certain process conditions, Alloy 718 forgings develop abnormal grain growth when heated to the solution temperature. This has not been a serious problem for small forgings (as discussed below), but it has been a serious problem for large forgings which, for purposes of this invention, are those over 10,000 pounds in weight.

Abnormal grain growth, also referred to as secondary grain growth or critical grain growth, occurs when a few grains in the material grow to a very large size compared to neighboring grains. This occurrence alters the mechanical properties of the material. Specifically, not only does abnormal grain growth reduce fatigue resistance and yield strength of the material, it also impairs the ability to detect small defects by ultrasonic testing. Abnormal grain growth does however, improve creep resistance at high temperatures, and may therefore be desirable in certain instances.

The possibility of developing abnormal grain growth in Alloy 718 forgings has been known for some time. A prior document which describes abnormal grain growth in Alloy 718 and conditions which promote abnormal grain growth is the "Study of Secondary Grain Growth on 781 Alloy" by J. F. Uginet and B. Pieraggi; The Minerals, Metals and Materials Society, 1997. Abnormal grain growth was not regarded as a serious problem in that process modifications were available that minimized or eliminated its occurrence. These process modifications, however, work well with small forgings but not with large forgings as defined above. More specifically, with small parts, one could:

1. Avoid low strains (amount of upsets in a forging step). There are some difficulties in doing this for large parts because the press capacity may allow only small upsets each time.
2. Use higher strain rates (related to the speed at which the top dies move). This again will not work for very large parts because the higher strain rates require higher press loads that would exceed the capacity of the largest presses in the world.
3. Avoid doing a solution treatment and do a direct age instead. This works out well for small parts because the cooling rate in air after completion of forging is adequate to ensure a fully solutioned structure for a small part. If air cooled after forging, the cooling rate at the center of very large parts will be very slow and will not have a fully solutioned structure. The absence of a fully solutioned structure means that the part will not develop high strength after the aging heat treatment. Therefore, after the solution treatment, the parts must be quenched in oil/water to retain a fully solutioned structure.

BRIEF SUMMARY OF THE INVENTION

This invention involves the identification of a unique processing window for large Alloy 718 forgings which causes abnormal grain growth. By then avoiding this window, abnormal grain growth can be eliminated, thereby permitting large forgings that have a uniform grain structure. Alternatively, the process permits the formation of abnormal grain growth in selected areas when considered desirable.

Initially, a study on the effect of forging parameters was carried out using small specimens, but the process was made to simulate the processing of large forgings. It was observed that abnormal grain growth occurs under specific conditions of:

(a) starting grain size;

(b) forging temperatures;

(c) forging strains;

(d) forging strain rates;

(e) number of upsets; and (f) solution treatment temperature.

In one embodiment of this invention, abnormal grain growth can be avoided by a forging process which takes into account the above factors, within the parameters disclosed herein.

In an alternative embodiment of the invention, where there is a need to intentionally create abnormal grain growth in any areas of a forging, items (c) and (f) are altered, as also described further herein.

More specifically, the present invention relates generally to a process for forging large components of Alloy 718 material comprising:

a) providing a billet with an average grain size between ASTM 0 and ASTM 3;

b) heating the billet to a temperature of between 1750° F. and 1800° F.;

c) upsetting the billet to obtain a component part with a minimum strain of 0.125 in at least selected areas of the part;

d) reheating the component part to a temperature between 1750° F. and 1800° F.;

e) upsetting the component part to a final configuration such that the selected areas receive no strains between 0.01 and 0.125;

f) solution treating the component part at a temperature of between 1725° F. and 1750° F.; and g) aging the component part over predetermined times at different temperatures.

When there is a need to intentionally create abnormal grain growth in any areas of a forging, then steps e) and f) are changed only as follows.

e) finish forge the part to intentionally create strains of 0.01 to 0.125 in the required areas.

f) solution treat the component part at 1825–1850° F.

The process in accordance with the invention has advantages over the prior art. Specifically, one can develop a control process which can eliminate abnormal grain growth and have a uniform grain structure specifically for large 718 alloy forgings. Alternatively, one can develop a control process which does produce abnormal grain growth intentionally in specific areas to meet specific property needs. This aspect can be used in both large and small forgings.

BRIEF DESCRIPTION OF THE DRAWINGS

FIG. 3 is a model of the specimen showing strain contours and measurements for use as a reference;

FIG. 4 is a model of a component part forged by a conventional process; and

FIG. 5 is a model of a component part forged by the process of the invention.

DETAILED DESCRIPTION OF THE INVENTION

Figure 1:
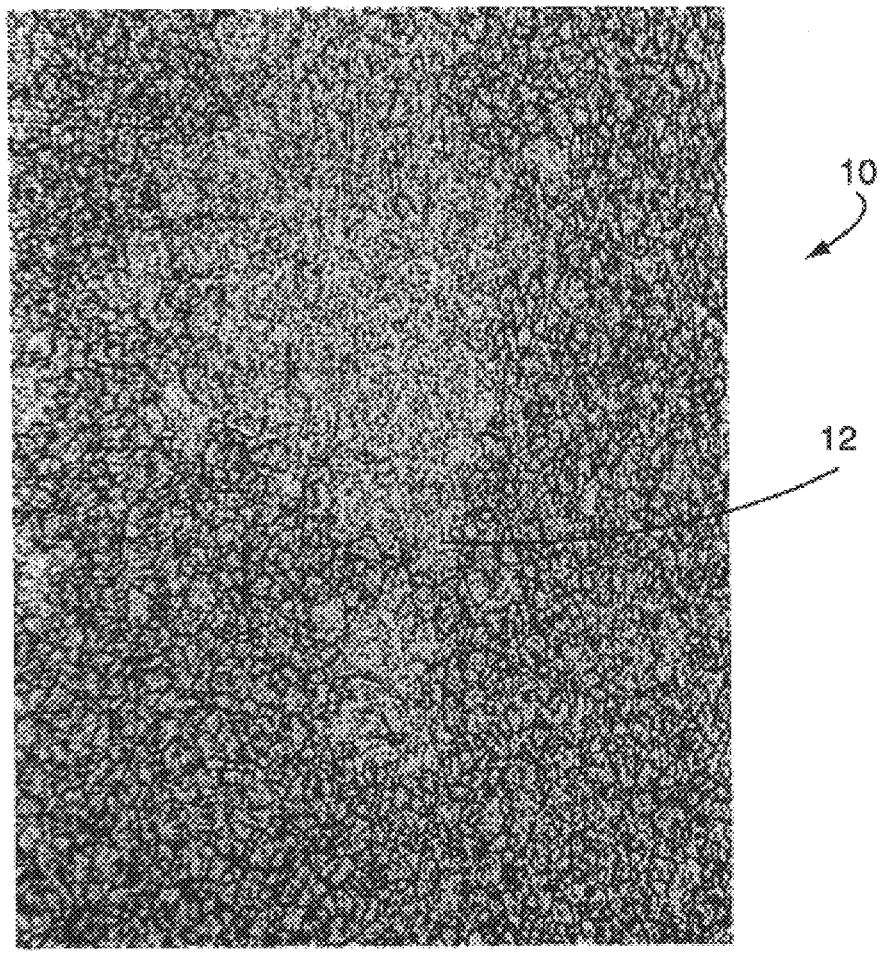
FIG. 1 is a photomicrograph showing evidence of abnormal grain growth in an alloy 718 component.

With reference to FIG. 1, an example of abnormal grain growth is shown in a photomicrograph with a magnification of 200×. Specifically, evidence of abnormal grain growth is shown in the gray areas, one of which is designated by numeral 12. As indicated above, abnormal grain growth occurs when a few grains in the material grow to a very large scale compared to neighboring grains. Abnormal grain growth reduces fatigue resistance and yield strength of the material. It also impairs the ability to detect small defects by ultrasonic testing. On the other hand, since abnormal grain growth does improve creep resistance at high temperatures, it may be desirable to foster such growth under certain circumstances.

Figure 2:
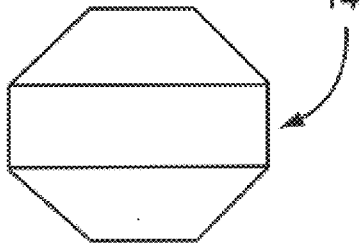
FIG. 2 is an end view illustrating the cross sectional shape of a small scale specimen used in the development of the invention.

For purposes of developing the process in accordance with this invention, small scale specimens were used. The specimens initially as supplied for testing had a cross sectional shape as indicated in FIG. 2. A side elevation of the specimen is shown generally in FIG. 3. The specimen in FIG. 3 is also shown to include typical strain contours, with strains in each labeled area indicated adjacent the figure.

The process developed in accordance with the invention is based on the test regimen described below.

The small scale specimen or billet 14 is an Alloy 718 forge material with grain size of ASTM 4–5 and ASTM 8–10. The specific geometry of the specimen as shown in FIGS. 2 and 3 allowed strains of different levels to be generated in the same specimen, thus minimizing the number of specimens.

The test methodology included small scale upsets done in a servo-hydraulic testing machine. The specimen 14 and forging dies were both heated and maintained at the temperature of testing, i.e., it was an isothermal process. Finite element modeling of the forging process was done using a commercial code DEFORM.

The following parameters were initially considered as factors in the occurrence or prevention occurrence of abnormal grain growth:

(1) starting grain size;

(2) forging strain;

(3) number of upsets;

(4) reheat time during upsets;

(5) solution treatment time;

(6) cooling rate;

(7) forging temperature;

(8) forging strain rate;

(9) solution treatment temperature.

A preliminary study of the test results showed the following:

(1) Abnormal grain growth does not occur if the grain size is larger than ASTM 8.

(2) The number of upsets did not have a significant effect.

(3) The reheat time was controlled by the size of the forging. Large parts need longer reheat times.

(4) The solution treatment time was also controlled by the size of the part.

(5) The cooling rate from solution treatment temperature was also controlled by the size of the part.

A detailed Design of Experiments (DOE) study was done with the remaining factors, using eight sub-scale test specimens as shown in FIG. 2, based on the following matrix.

| | Forging Temperature (F.) | Strain Rate | Solution Temperature (F.) |
|---|---|---|---|
| 1 | 1775 | 0.01 | 1725 |
| 2 | 1775 | 0.01 | 1760 |
| 3 | 1775 | 0.03 | 1725 |
| 4 | 1775 | 0.03 | 1760 |
| 5 | 1800 | 0.01 | 1725 |
| 6 | 1800 | 0.01 | 1760 |
| 7 | 1800 | 0.03 | 1725 |
| 8 | 1800 | 0.03 | 1760 |

Specimens were cut up after the upset experiments for microstructure analysis. It was observed that the abnormal grain growth was located in the low strain region, but when strain reached a certain level, the abnormal grain growth disappears. The locations of abnormal grain growth were recorded and strain level at the certain location was then calculated by commercial forge modeling software DEFORM 2D. The highest strain value (Hstrain) of each specimen represents the amount of abnormal grain growth in the particular specimen. By running statistic software Minitab 12, it was determined that lowering forging temperature and lowering the solution heat treatment temperature could reduce Hstrain and thus the possibility of abnormal grain growth, but strain rate has little effect on Hstrain and thus the amount of abnormal grain growth generated.

Extensive modeling of the finish forging steps of the full size forging was made. Forgings which had evidence of abnormal grain growth were cut up and locations correlated with the temperature/strain/strain rate history of the small scale specimens. After this correlation was established it was possible to design a process which would avoid abnormal grain growth. In addition, the solution treatment temperature was reduced to 1725F.

A comparison of the forged samples 22, 24 in FIGS. 4 and 5 illustrate the reduced area of low strain and thus reduced abnormal grain growth achieved by the process of this invention. With reference to FIGS. 4 and 5, samples 22 and 24 each include a double cone-shaped geometry, with a notch at 16 and annular steps or shoulders formed at 18 and 20. The samples 22 and 24 are components made by a conventional process, and by a process in accordance with this invention, respectively. Sample 22 in FIG. 4 exhibit a relatively large area in the low strain range, which has a tendency for abnormal grain growth. On the other hand, sample 24 in FIG. 5 shows a very limited low strain region. This low strain region will be removed by subsequent machining and the possibility of abnormal grain growth is thus eliminated.

Based on the above described test results, it was determined that in order to avoid abnormal grain growth, the following process should be employed:

a) Start from a billet of average grain size ASTM 0 to ASTM 3.

b) Heat the part to a temperature between 1750° F. and 1800° F.

c) Upset forge the part in to get a minimum strain of 0.125 in all areas of the part for each upset; this will recrystallize the part to a fine grain size of ASTM 6–8.

d) Reheat the part at a temperature of 1750° F. to 1800° F.

e) Upset forge again (if necessary) to get a minimum strain of 0.125 in all areas of the part for each upset.

f) Reheat the part (if step e) is performed) at a temperature of 1750° F. to 1800° F.

g) Final forge the part so that no areas of the forging receives a strain of between 0.01 and 0.125. Do not reheat the forging or re-strike it at this stage as it is very likely to cause abnormal grain growth.

h) Solution treat the part at a low temperature of 1725° F.–1750° F.

i) Age the part at 1325° F. for 8 hours followed by another 8 hours at 1150° F. (This is a standard practice for Alloy 718).

With the above process, abnormal grain growth can be eliminated from all areas of the component part.

When there is a need to intentionally create abnormal grain growth in any areas of a forging, then steps g) and h) are changed only as follows.

g) Finish forge the part to intentionally create strains of 0.01 to 0.125 in the required areas.

h) Solution treat the part at 1825–1850° F.

In this way, the component part can be selectively forged to create areas with no abnormal grain growth as well as areas where abnormal grain growth occurs but where creep resistance at high temperatures is improved.

In still another alternative, if the start-up grain size of the billet in step a) above is ASTM8–10, then steps b) and c) can be eliminated, and the process can continue with step d).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for forging a gas turbine component having a weight of at least 10,000 lbs. from Alloy 718 material so that the component does not exhibit any abnormal grain growth, comprising the steps of:

a) providing a billet with an average grain size between ASTM 0 and ASTM 3;

b) heating the billet to a temperature of between 1750° and 1800° F.;

c) upsetting the billet to obtain a component part with a minimum strain of 0.125 in at least selected areas of the part;

d) reheating the component part to a temperature between 1750° and 1800° F.;

e) upsetting the component part to a final configuration such that no areas of the component part receive strains between 0.01 and 0.125;

f) solution treating the selected areas of the component part at a temperature of between 1725° F. and 1750° F.; and g) aging the selected areas of the component part over predetermined times at different temperatures.

2. The process of claim 1 wherein, in step g), the component part is aged for 8 hours at 1325° F. and 8 hours at 1150° F.

3. The process of claim 1 wherein steps c) and d) are repeated as necessary to obtain a minimum strain in said selected areas of 0.125.

4. The process of claim 1 wherein, following step e), the component part has a fine grain size of ASTM 6–8 in said selected areas.

5. A process for forging a gas turbine component having a weight of at least 10,000 lbs. from Alloy 718 material so that the component does not exhibit abnormal grain growth in selected areas of the part but does exhibit abnormal grain growth in other areas of the part, comprising the steps of:

a) providing a billet with an average grain size between ASTM 0 and ASTM 3;

b) heating the billet to a temperature of between 1750° F. and 1800° F.;

c) upsetting the billet to obtain a component part with a minimum strain of 0.125 in all areas of the part;

d) reheating the component part to a temperature between 1750° F. and 1800° F.;

e) upsetting the component part to a final configuration such that said selected areas receive no strains between 0.01 and 0.125 and said other areas receive strains between 0.01 to 0.125;

f) solution treating the component part at a temperature of between 1825° F. and 1850° F.;

g) aging the component part over predetermined times at different temperatures.

6. The process of claim 5 wherein, in step g), the component part is aged for 8 hours at 1325° F. and 8 hours at 1150° F.

* * * * *